US006269730B1

(12) United States Patent
Hawkes et al.

(10) Patent No.: US 6,269,730 B1
(45) Date of Patent: Aug. 7, 2001

(54) RAPID AIMING TELEPRESENT SYSTEM

(75) Inventors: Graham S. Hawkes, San Anselmo; Howard F. Konvalin, Martinez, both of CA (US)

(73) Assignee: Precision Remotes, Inc., Point Richmond, CA (US)

( * ) Notice: Subject to any disclaimer, the term of this patent is extended or adjusted under 35 U.S.C. 154(b) by 0 days.

(21) Appl. No.: 09/425,336

(22) Filed: Oct. 22, 1999

(51) Int. Cl.[7] ..... F41G 3/26; F41G 3/00; F41G 5/06

(52) U.S. Cl. ..... 89/41.05; 89/41.15; 89/41.08

(58) Field of Search ..... 89/41.05, 41.04, 89/41.07, 41.08, 41.15, 203, 204, 135, 136

(56) References Cited

U.S. PATENT DOCUMENTS

| | | | | |
|---|---|---|---|---|
| 3,313,209 | * | 4/1967 | Thompson | 89/41.15 |
| 3,711,638 | * | 1/1973 | Davies | 89/42.05 |
| 3,798,795 | * | 3/1974 | Michelsen | 89/41.05 |
| 3,824,699 | * | 7/1974 | Lenz et al. | 89/41.11 |
| 4,112,818 | * | 9/1978 | Garehime, Jr. | 89/41.05 |
| 4,439,156 | * | 3/1984 | Marshall et al. | 434/12 |
| 4,639,222 | * | 1/1987 | Vishlizky | 434/20 |
| 4,777,864 | * | 10/1988 | Siech et al. | 89/135 |
| 4,922,801 | * | 5/1990 | Jaquard et al. | 89/41.05 |
| 4,967,641 | * | 11/1990 | Chambre | 89/41.08 |
| 5,210,371 | * | 5/1993 | Schneider et al. | 89/41.15 |
| 5,263,396 | * | 11/1993 | Ladan et al. | 89/41.05 |
| 5,379,676 | * | 1/1995 | Profeta et al. | 89/41.05 |
| 5,587,718 | * | 12/1996 | Iardella et al. | 89/41.08 |
| 5,599,187 | | 2/1997 | Mesiano . | |
| 5,686,690 | * | 11/1997 | Lougheed et al. | 89/41.05 |
| 5,790,085 | * | 8/1998 | Hergesheimer | 89/41.07 |
| 5,949,015 | * | 9/1999 | Smith et al. | 89/41.05 |
| 6,067,890 | * | 5/2000 | Thiesen et al. | 89/41.05 |
| 6,097,315 | * | 8/2000 | Minter | 89/41.08 |

* cited by examiner

*Primary Examiner*—Darren W. Ark
(74) *Attorney, Agent, or Firm*—Thelen Reid & Priest LLP

(57) ABSTRACT

The present invention provides a powered aiming platform for pointing devices such as firearms, illumination devices, or sensing instruments, remotely controlled by a hand-controller device, with video feedback of the aiming position and audio feedback of the exact direction and speed of positioning movements. The present invention overcomes the safety and accuracy limitations of manual and conventional remotely-controlled aiming mechanisms, thereby allowing operators to point devices accurately and quickly with predictable, precise control. In the case of firearms, the present invention maintains a steady position after repeated firing.

2 Claims, 8 Drawing Sheets

RAPID AIMING TELEPRESENT SYSTEM

BACKGROUND OF THE INVENTION

Field of the Invention

The present invention relates generally to aiming systems, and specifically to remote control systems for pointing real-world devices and computer pointers at intended targets using perceptual feedback indicating the direction of aim and changes to the direction of aim.

BRIEF DESCRIPTION OF THE DRAWINGS

The purpose and advantages of the present invention will be apparent to those skilled in the art from the following detailed description in conjunction with the appended drawings, which show a preferred embodiment of the invention, and in which.

DETAILED DESCRIPTION OF THE PREFERRED EMBODIMENTS

Figure 1:
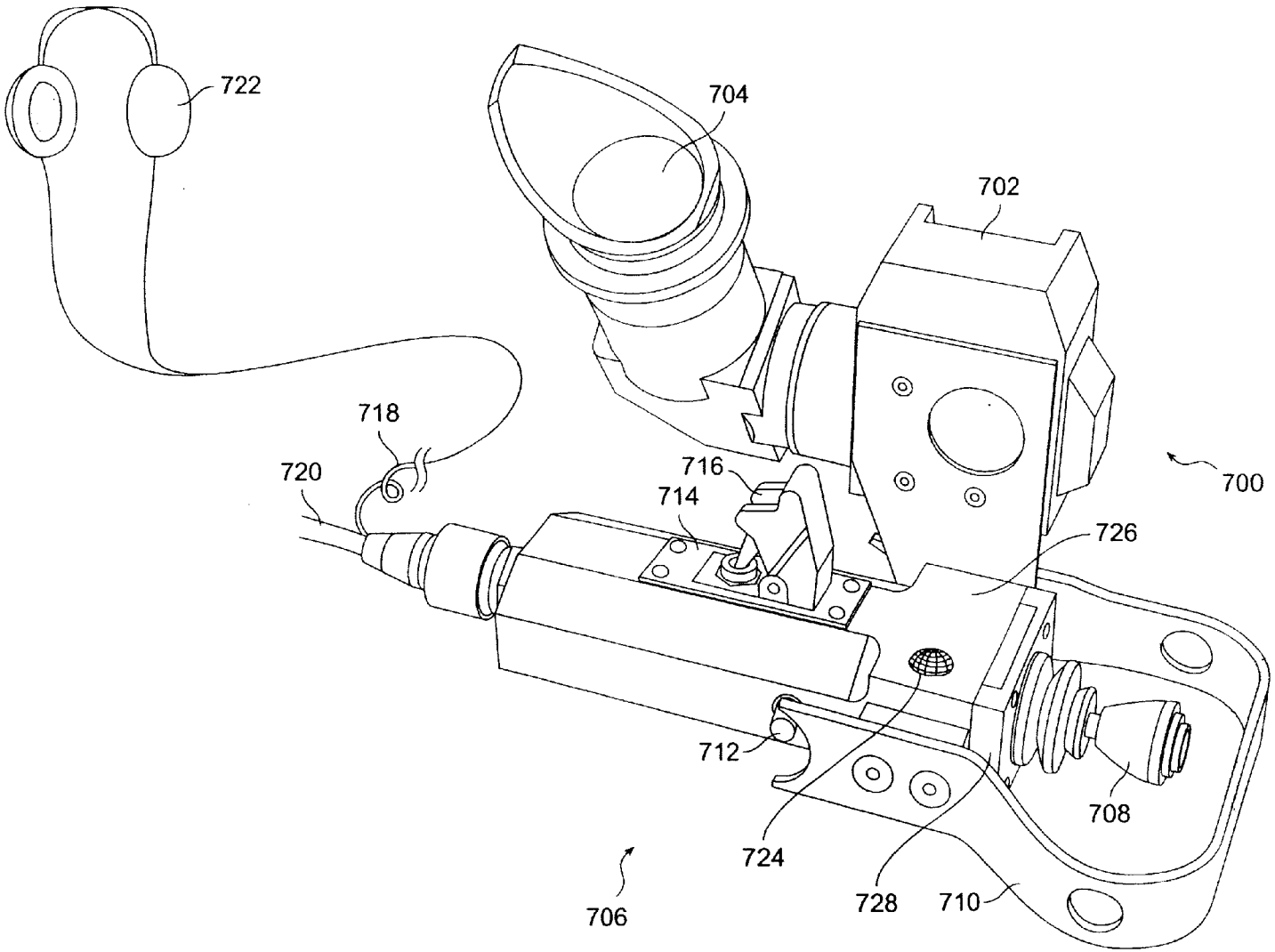
FIG. 1 is an illustration showing a two-axis hand control device constructed in accordance with the present invention that generates directional control signals, and includes a joystick and an optional portable viewfinder.

Reference will now be made in detail to the described embodiment of the invention, so as to enable a person skilled in the art to make and use the invention in the context of a particular application, namely that of aiming a firearm. It is understood that this example is not intended to limit the invention to one preferred embodiment or application. On the contrary, it is intended to cover alternatives, modifications, and equivalents. Various modifications to the present invention will be readily apparent to one of ordinary skill in the art, and can be made to the described embodiment within the spirit and scope of the invention as defined by the appended claims.

For a better understanding, components of the described embodiment are labeled with three and four-digit component numbers. In general, the same first digit is used throughout all of the component numbers numbered and labeled within a figure. Like components are designated by like reference numerals throughout the various figures.

The Hand Controller

FIG. 1 depicts two-axis hand controller device 706 constructed in accordance with the present invention, attached to an optional portable viewfinder 700. Hand controller device 706 includes two-axis joystick 708 which is manually operated by users of the present invention. Control signals generated by these controls are transmitted along transmission cable 720. The two-axis hand controller device also optionally contains a hand stabilizer guard 710 which the operator may hold, as well as various additional controls 712, 714, and 716 operated by the user.

In the described embodiment hand controller device 706 also includes an attached audio output cable 718 which powers stereo headphone speakers 722. In alternate embodiments sound is provided by built-in speaker 726 attached to hand controller device 706, or an external speaker connected to output cable 718. Hand controller device 706 further includes optional visual indicators 728, and optional tactile signal generator 724. In the preferred embodiment indicators 728 are light emitting diodes (LED's), although other forms of electronic display may be used. In the described embodiment tactile generator 724 is a motor that operates on command to provide a vibrating sensation in joystick 708 and hand guard 710.

Figure 2:
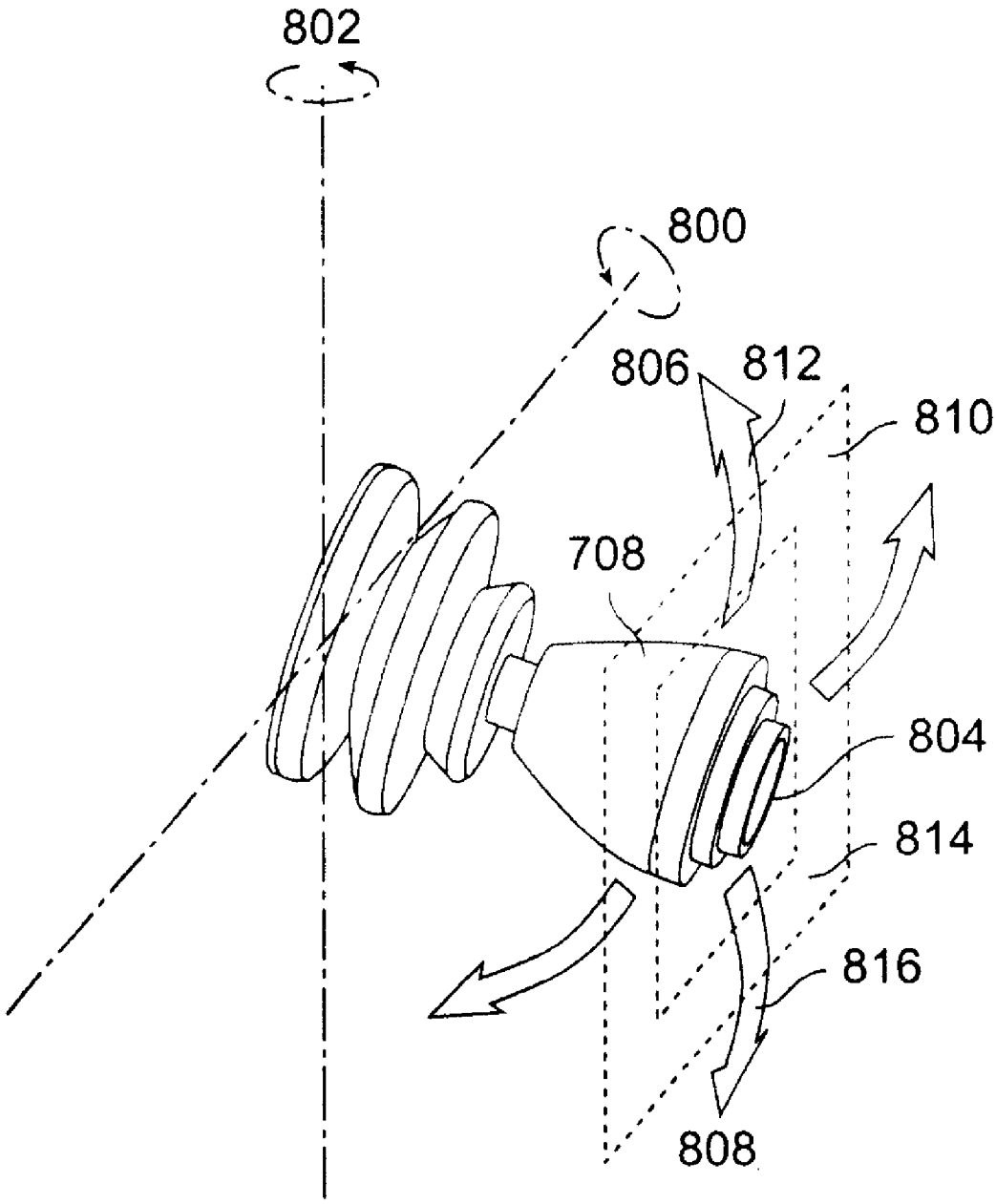
FIG. 2 is a diagram illustrating various positions and zones along which the joystick may be operated in accordance with the present invention.

Turning briefly to FIG. 2, joystick 708 is capable of movement along a first axis 800 and a second axis 802. For each axis there is a mechanical return-to-center feature which automatically returns the joystick 708 to a center position within dead zone 804 approximately in the center of the range of motion of the joystick 708. For each axis there is a positive direction 806 and a negative direction 808 of displacement from the dead zone 804. For each axis, there is a single positive step region 810 in the positive direction 806 from the dead zone 804, a region of positive displacement 812 farther in the positive direction 806 from the single positive step region 810, a single negative step region 814 in a negative direction 808 from the dead zone 804, and a region of negative displacement 816 farther in the negative direction 808 from the single negative step region 814.

Those skilled in the art will recognize that any manually operated two axis controller may be suitable for generating a configuration of zones as described above. For example, in alternate embodiments, the hand controller may incorporate a trackball, a pressuresensitive pointing device, a mouse, or other two-axis control devices, in place of or in addition to the joystick 708. In the case of a trackball, the various regions and return-to-center feature may function in a manner identical to that of the joystick of the described embodiment. Alternately, the output of the trackball may be determined by the motion of speed of the trackball along two axes. For example, no motion or a motion along one axis that is slower than a threshold value may generate a "dead zone" output signal for that axis. There may also be a range of motion speeds greater than the threshold described above that corresponds to a single positive and negative step for each axes. Finally there may be a region of motion speeds greater than those of the single step zone, corresponding to the positive and negative displacement regions of the joystick. A mouse may function identically to a trackball, although a return-to-center feature is not contemplated for the mouse.

Display Means

Figure 3:
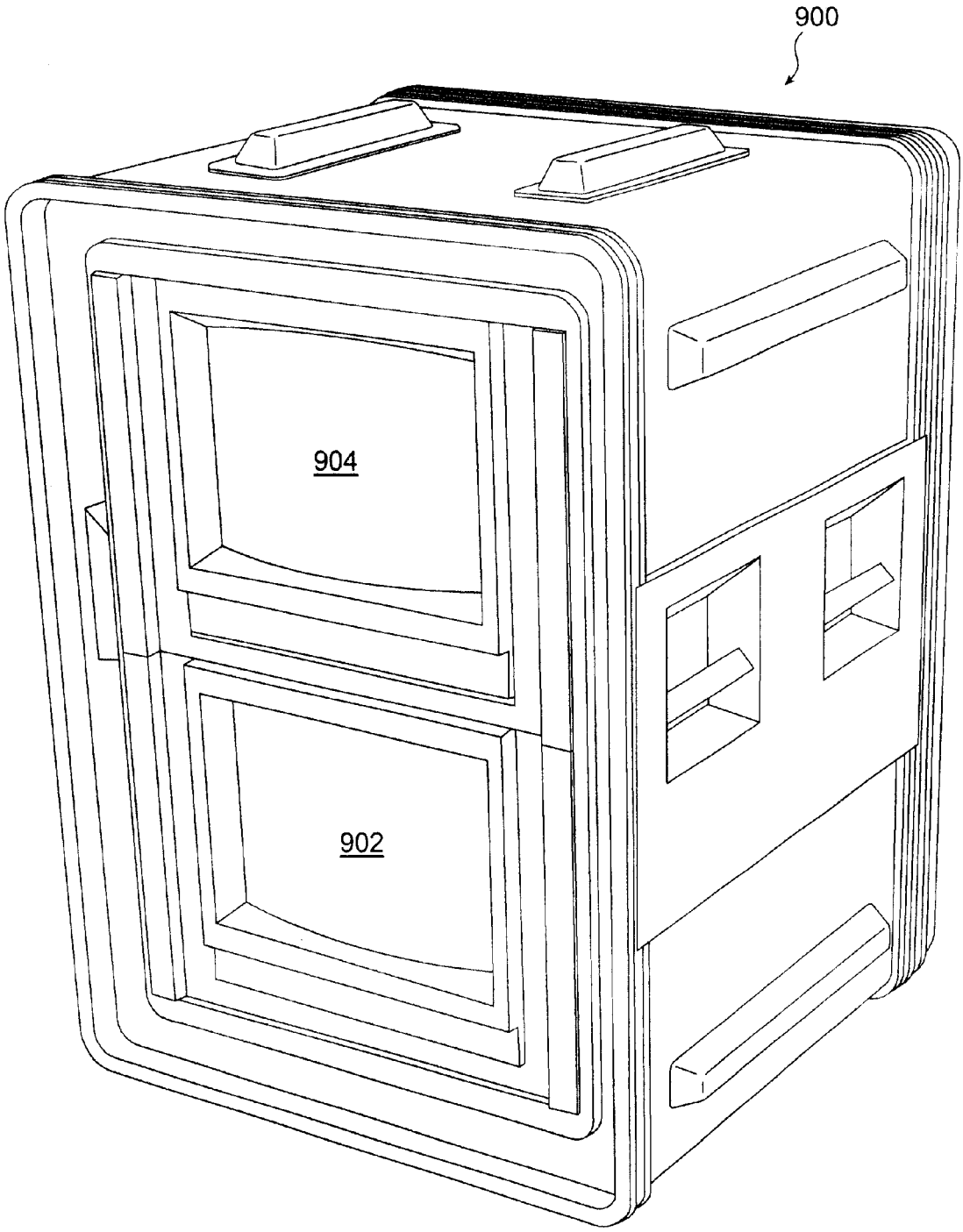
FIG. 3 is an illustration of a display device that displays live video images of the pointing direction and an intended target location.

FIG. 3 is a display device used to project information about an intended target and pointing direction. In the described embodiment display device 900 consists of two computer display screens 902 and 904. In other described embodiments display device 900 may consist of any of a number of systems that may display visual information, including one or more video display systems, optical views or projections, or fiber optic signal transmissions.

Pointing device 300 may also be a sensing instrument such as a video or still camera or sensor, a motion picture camera or sensor, an infrared camera or sensor, a motion sensor, a directional microphone, a spectrometer, a range finder, or a radar receiver. Pointing device 300 may also be an illumination devices such as a spotlight, stage light, laser, radar gun, or searchlight.

Figure 4A:
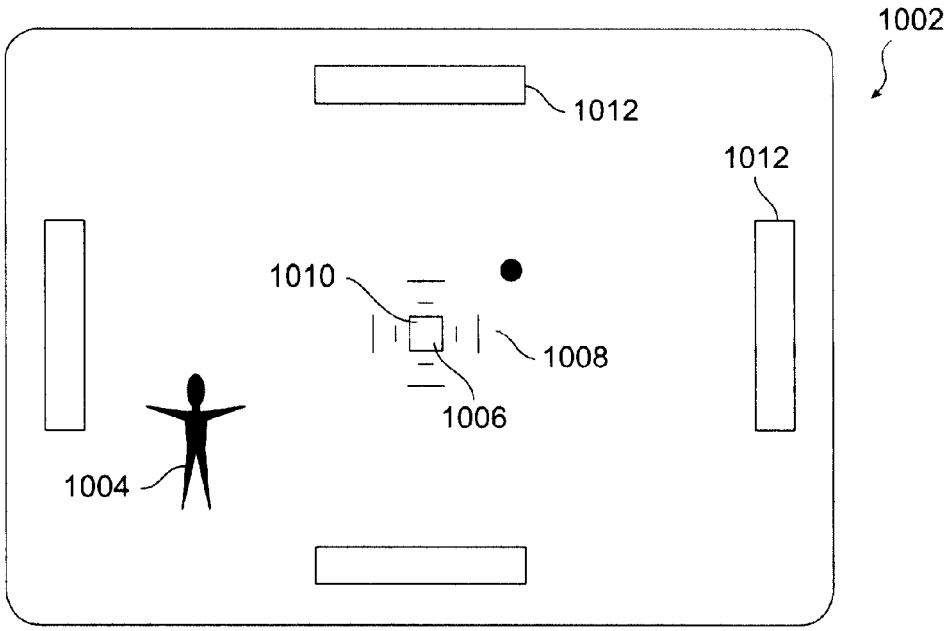
FIG. 4 is a sample computer display screen showing an intended target location, a pointing direction, and markers for movement in various directions.
Figure 4B:
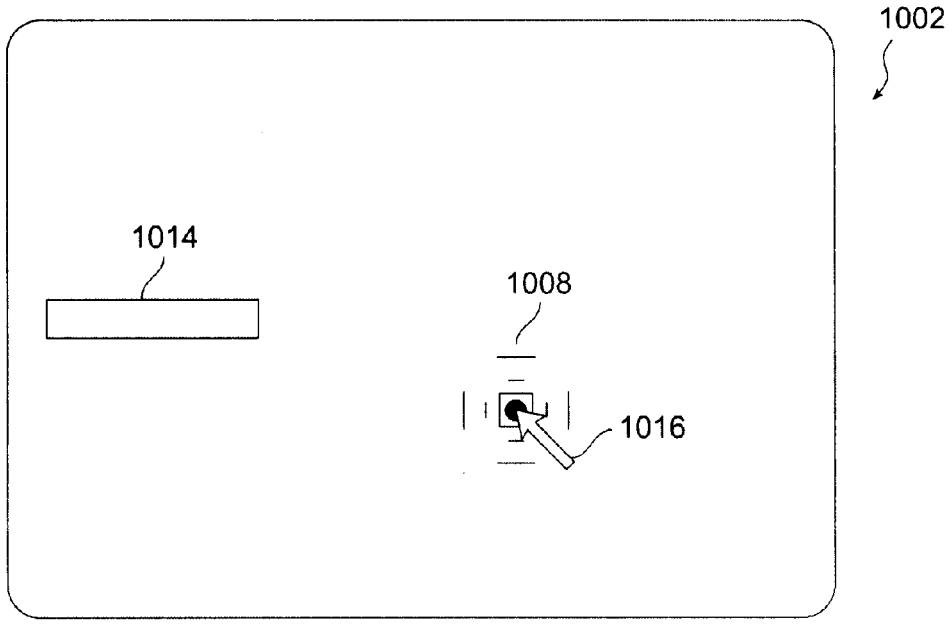

FIGS. 4*a* and 4*b* illustrate typical video or computer images from devices constructed in accordance with the present invention. In FIG. 4*a* screen 1002 is a typical display used for pointing an external pointing device at physical target 1004. In the described embodiment screen 1002 displays a live video image of the area in the vicinity of target 1004, as well as the current pointing direction 1006. This image and various other objects appearing on the screen may be made by direct video acquisition, as in a video camera mounted to the device being pointed, by computer simulation or representation, or by a combination of the two.

In the described embodiment screen 1002 further includes optional two-axis calibration indicators 1008, such as the reticle which is pictured, to indicate both the targeting centerpoint 1010 and the distance from the targeting centerpoint of target 1004 and other objects that may appear onscreen.

In one preferred embodiment, the targeting centerpoint 1010 and the current pointing direction 1006 are at the same screen location. This is the normal configuration when the invention is used in connection with the pointing of computer-simulated devices, or physical devices where the actual direction targeted is the same or within a very close proximity to the pointing direction. Examples of such devices include cameras, lasers, or firearms at close range.

In other preferred embodiments targeting centerpoint 1010 is offset from current pointing direction 1006 to account for optical, mechanical, or other effects that might cause the actual location targeted by a device to be offset from the direction in which the device is pointed. For example, in a long-range firearm application such as a sniper rifle, gravitational effects will generally cause any projectile that is fired by the device to deviate downward from the pointing location. Additionally, wind may cause the projectile to the side, as well as up or down, and the time lag between activating the device and reaching the target location 1004 will also introduce a shift in the event the target 1004 is moving. In one preferred embodiment the offset between targeting centerpoint 1010 and current pointing direction 1006 is fixed or determined mechanically. This fixed offset is useful in situations where the amount of deviation is known in advance, such as firing a known firearm at a known range. In other preferred embodiments the offset may be determined by the operator, or else calculated in response to known or measured conditions such as range, wind speed, and movement of target 1004.

Targeting centerpoint 1010 may consist of a single point, or else a shape that depicts a range of possible targeting outcomes. In the case of firearms, for example, a certain amount of uncertainty is present regarding the exact location where a projectile will land, due to inconsistencies in firing mechanics, uncertainties over estimates or measurements of range, wind speed and other conditions, and also due to random deviation of flight paths. The shape and size of targeting centerpoint 1010, as well as any offset from the center of calibration indicators 1008, may all be fixed, operator-controlled, or calculated.

In the described embodiment, as the actual point of aim changes in response to user operation of two-axis hand controller device 106, the overall image displayed in screen 1002 is panned so that the image now displays the area surrounding the new point of aim, while keeping pointing direction 1006 stationary at the center of screen 1002. This effect is easily achieved by fixing a video camera to the physical pointing device, such that the camera is always pointing in the pointing direction of the device. In alternate embodiments, the center of screen 1002 tracks targeting centerpoint 1010 or target 1004, or is otherwise offset from pointing direction 1006, either by moving the video camera independently of the device, or by shifting the display by means of computer or video techniques. In yet other preferred embodiments, the image is obtained by a fixed overview camera, and targeting centerpoint 1010 and pointing direction 1006 are both moved on screen 1002 in response to user operation of the point of aim.

Finally, in FIG. 4*a* motion indicators 1012 consist of areas that flash or otherwise provide visual cues that indicate the direction and speed of movement of the point of aim in response to user operation. This feature will be described in more detail below.

Turning now to FIG. 4*b*, an alternate embodiment is shown whereby screen 1002 is a computer display, and where the user is operating two-axis hand controller device 106 in order to position screen cursor 1016 to a specific screen location. This application arises, for example, when using a mouse, joystick, or other computer input device to point to a specific location on a screen. In the illustration, the screen location is text-entry box 1014. Other targets may include by way of example, Internet browser buttons or hyperlinks, check boxes, graphics tags and other objects used by computer drawing programs, and game targets. Some or all of the features illustrated in FIG. 4*a* may be included as computer-generated screen objects, such as calibration indicators 1008.

In addition to display device 900 video display means are further provided on an optional portable viewfinder 700, as shown in FIG. 1, containing a small LCD video display 702 viewable through an eyepiece 704, which displays a screen similar to screen 1002. Other embodiments may provide for alternate or additional video display means for displaying screen 1002, including a head-mounted viewer, a small portable video display, and other video displays or computer-processed representations and models of video images.

Pointing Devices

Figure 5:
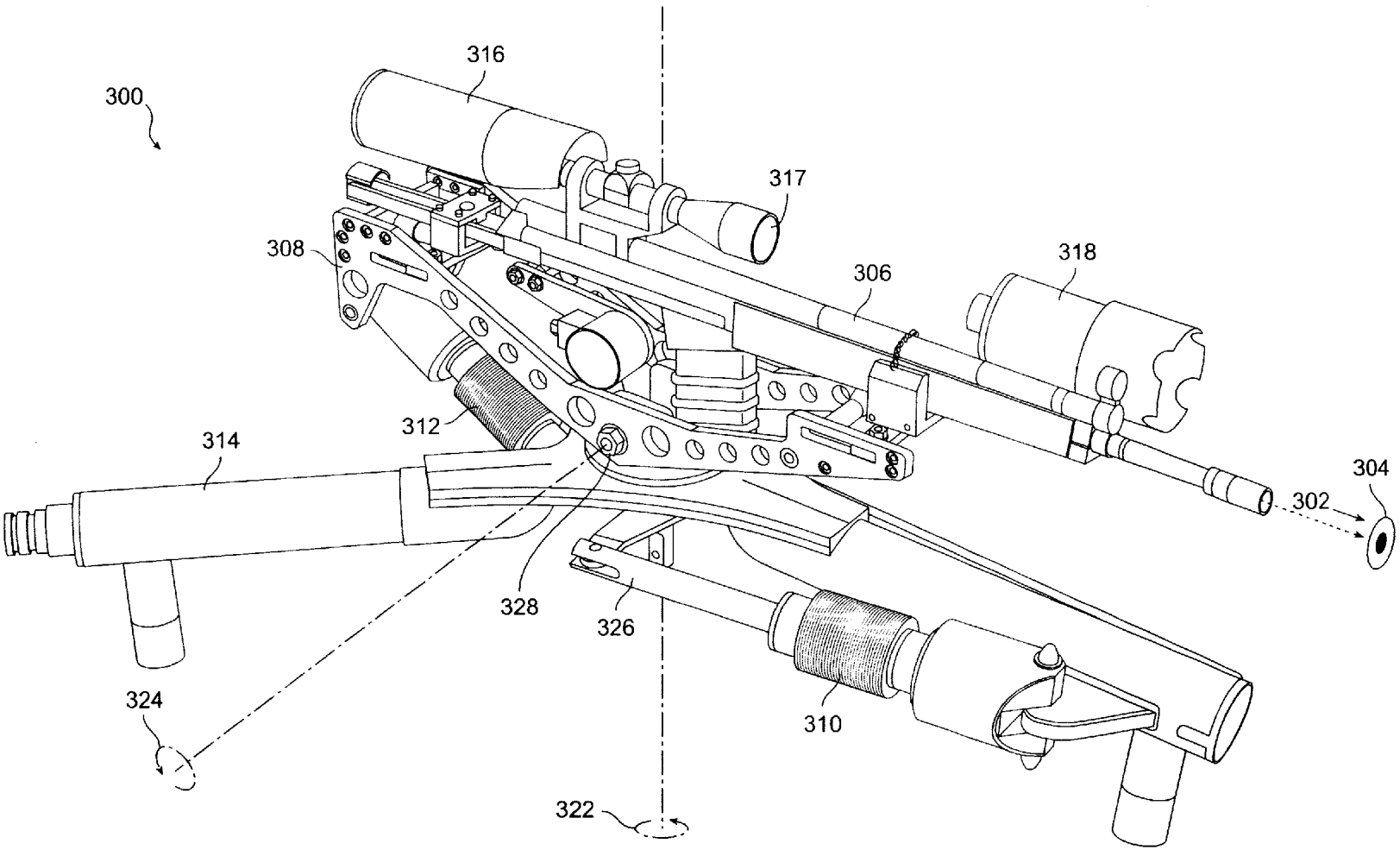
FIG. 5 is an illustration showing an aiming mechanism constricted in accordance with the present invention, which uses linear actuators to position a carriage containing a firearm device so that the firearm device points in an aiming direction towards an intended target.

FIG. 5 illustrates one among a variety of physical pointing devices that may be used in conjunction with the present invention. In the described embodiment physical pointing device 300 consists of firearm 306, mounted to carriage 308, which is connected to base 314 by two rotational mounts 326 and 328.

Specifically, first rotational mount 326 is a horizontal turntable mounted to base 314 and carriage 308, which rotates carriage 308 along first axis 322, which is approximately vertical. A first linear actuator 310 attached on one end to base 314 and on the other to carriage 308 operates by extending and distending in response to an electrical control signal generated in response to user operation of two-axis hand controller device 706 along a first operational axis, thus controlling the rotational position of the carriage along first axis 322.

Second rotational mount 328 is a horizontally-aligned axle which rotates carriage 308 along second axis 324, which is approximately horizontal. A second linear actuator 312 attached on one end to first rotational mount 326 and on the other end to carriage 308 operates by extending and distending in response to an electrical control signal generated in response to user operation of two-axis hand controller device 706 along a second operational axis, thus controlling the rotational position of the carriage along second axis 324.

Studying FIG. 5, it can be readily appreciated by those skilled in the art that by controlling the horizontal and vertical rotational position respectively, first linear actuator 310 and second linear actuator 312 control pointing direction 302 of firearm 306 and thus the targeting location 304. By controlling the precise extension of first linear actuator 310, the operator may set the precise azimuth of pointing direction 302 may be determined. By controlling the precise extension of second linear actuator 312 the operator may set the precise elevation of pointing direction 302.

Figure 6:
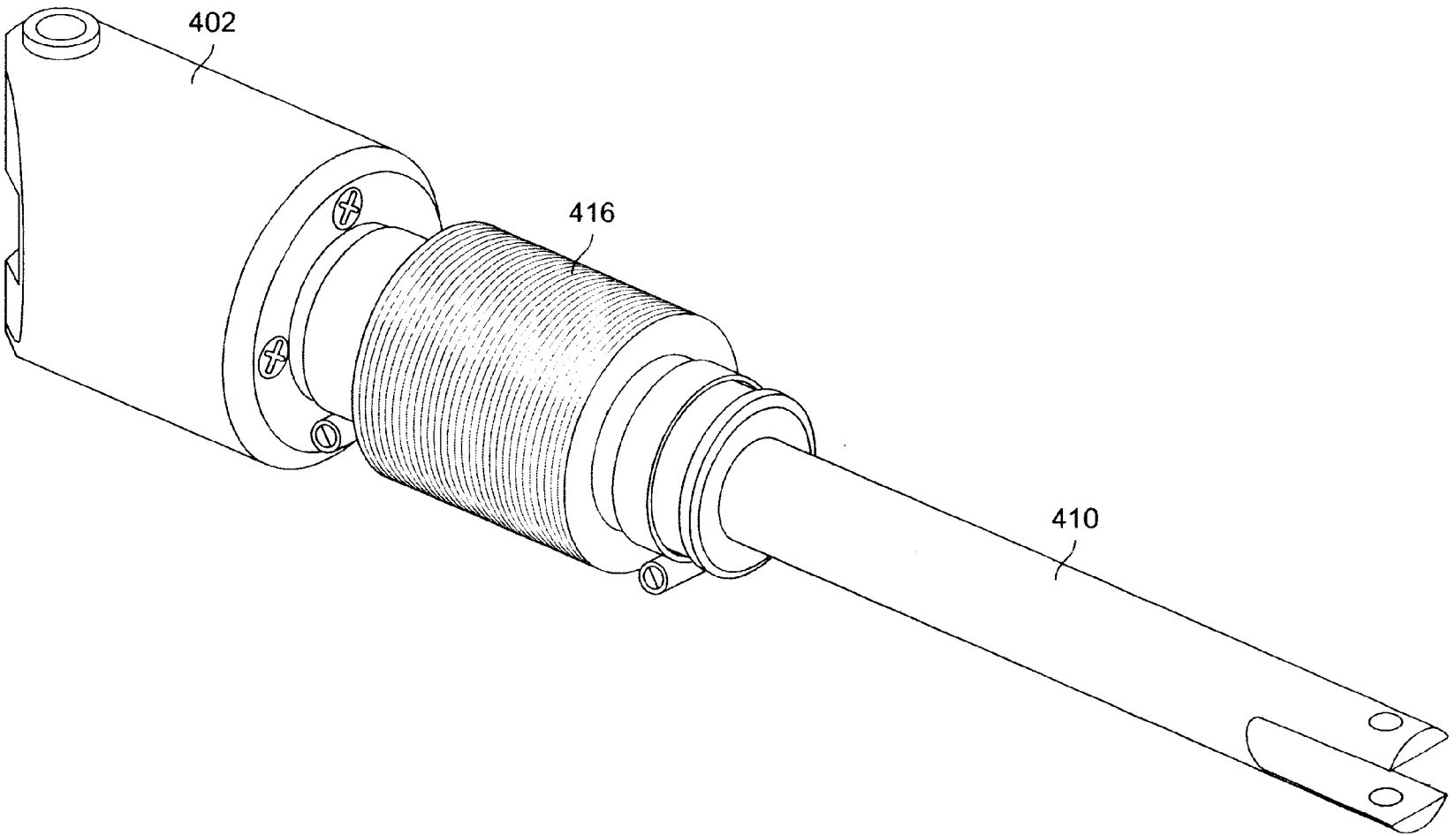
FIG. 6 is an illustration showing a linear actuator.
Figure 7:
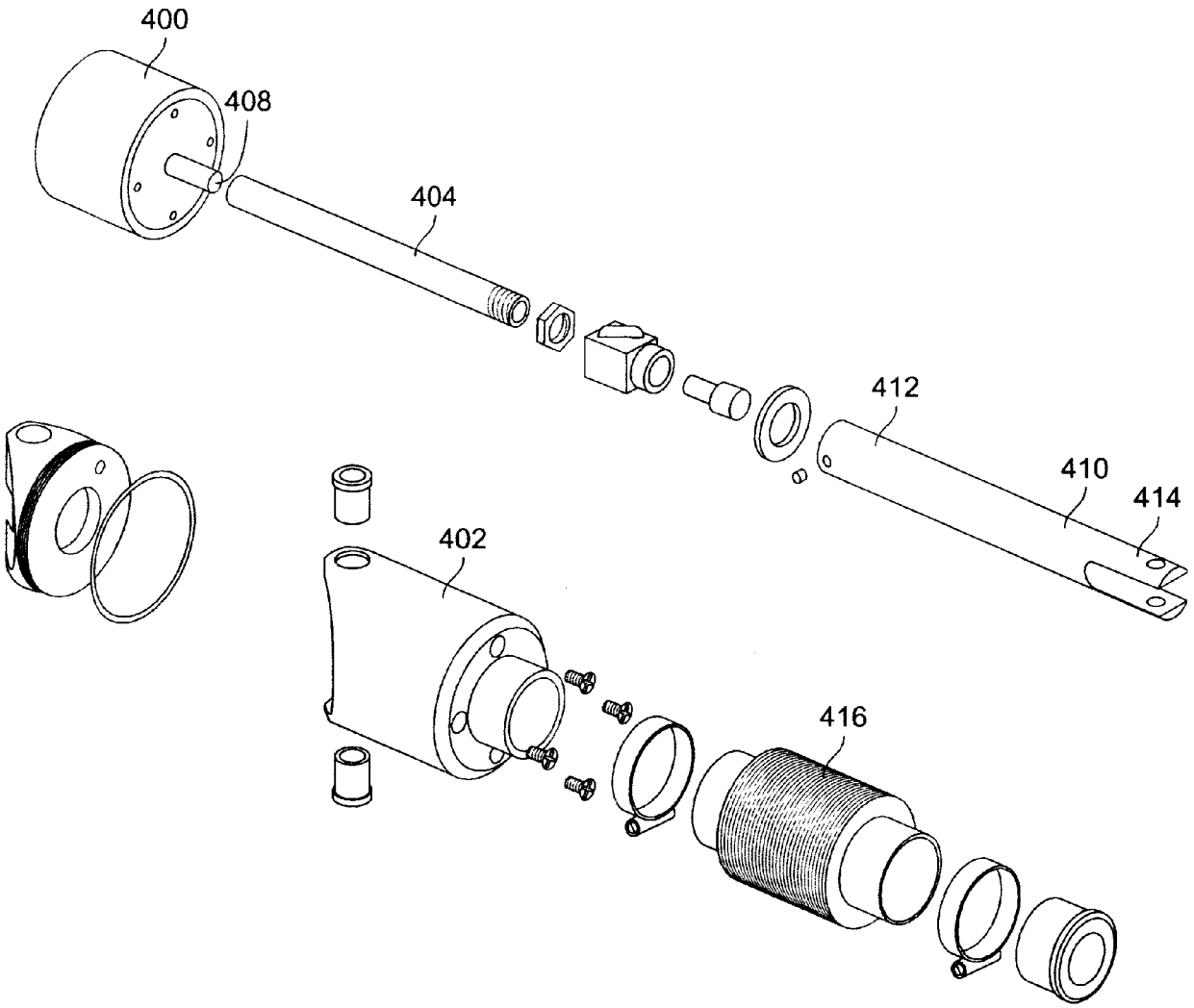
FIG. 7 is an illustration showing the disassembled sub components of a linear actuator, in the relative positions of such components when they are assembled.

FIG. 6 shows a linear actuator in more detail. Linear actuators 310 and 312 each consist of an electronic servomotor 400 housed inside a protective motor housing 402, with a threaded shaft 404 extending longitudinally from the electronic servomotor 400. The threaded shaft 404 rotates forward and backwards, or remains stationary, as operated by the electronic servomotor 400. In the described embodiment, each electronic servomotor 400 is an electronic stepper motor of a type readily available and well known to one of ordinary skill in the art. The forward and reverse rotation of such motors occurs in steps, each of a predetermined angular increment. Such stepper motors operate at precisely-controlled variable speeds in response to electrical control signals received at an electronic control input 406, ranging from stationary (zero steps per second) to at least 500 steps per second, and depending on the motor, as high as 3,000 or more steps per second. The motor rotates a motor shaft 408, which is linked to and thereby drives the threaded shaft 404. There is a further means for locking the threaded shaft 404 in place when it is not in operation.

Returning to FIG. 5, pointing device 300 includes two video acquisition means 316 and 318, mounted to carriage 308, and trained in pointing direction 302. In the described embodiment these means are each video cameras which obtain a live video image of targeting location 304. In the described embodiment, each camera has a 10-to-1 zoom ratio, resulting in a field of view that ranges from 4.3 to 43 degrees. Overview video camera 318 provides an overall view of targeting location 304. Aiming video camera 316 points through a spotting telescope 317. In the described embodiment spotting telescope 317 varies from 3 to 9-times magnification, and includes a reticle so as to indicate the exact pointing direction 302 of pointing device 300. The device further includes video transmission means to transmit the live video images to computer display screens 902 and 904. In the described embodiment pointing direction 302 corresponds to current pointing direction 1006 appearing on display screen 1002; targeting location 304 corresponds to targeting centerpoint 1010; and the video image of the reticle of spotting scope 317 generates two-axis calibration indicators 1008.

In other preferred embodiments a variety of other calibration and pointing schemes are possible. For example, one of ordinary skill in the art will recognize that many different types of actuators may be used as positioning means for the carriage, including ratchets, cams, and hydraulically-controlled activators. In fact, many different systems may be implemented for controlling the pointing direction 302 along two axes. The main requirement to any such pointing device is that means must be in place to reliably and predictably control the pointing direction and, optionally, the rate of change in the pointing direction 302, along two independent axes in response to operation of two axis hand controller 706, which is connected to pointing device 300 by electrical cable or other electrical transmission means.

Positioning Control Means

Figure 8:
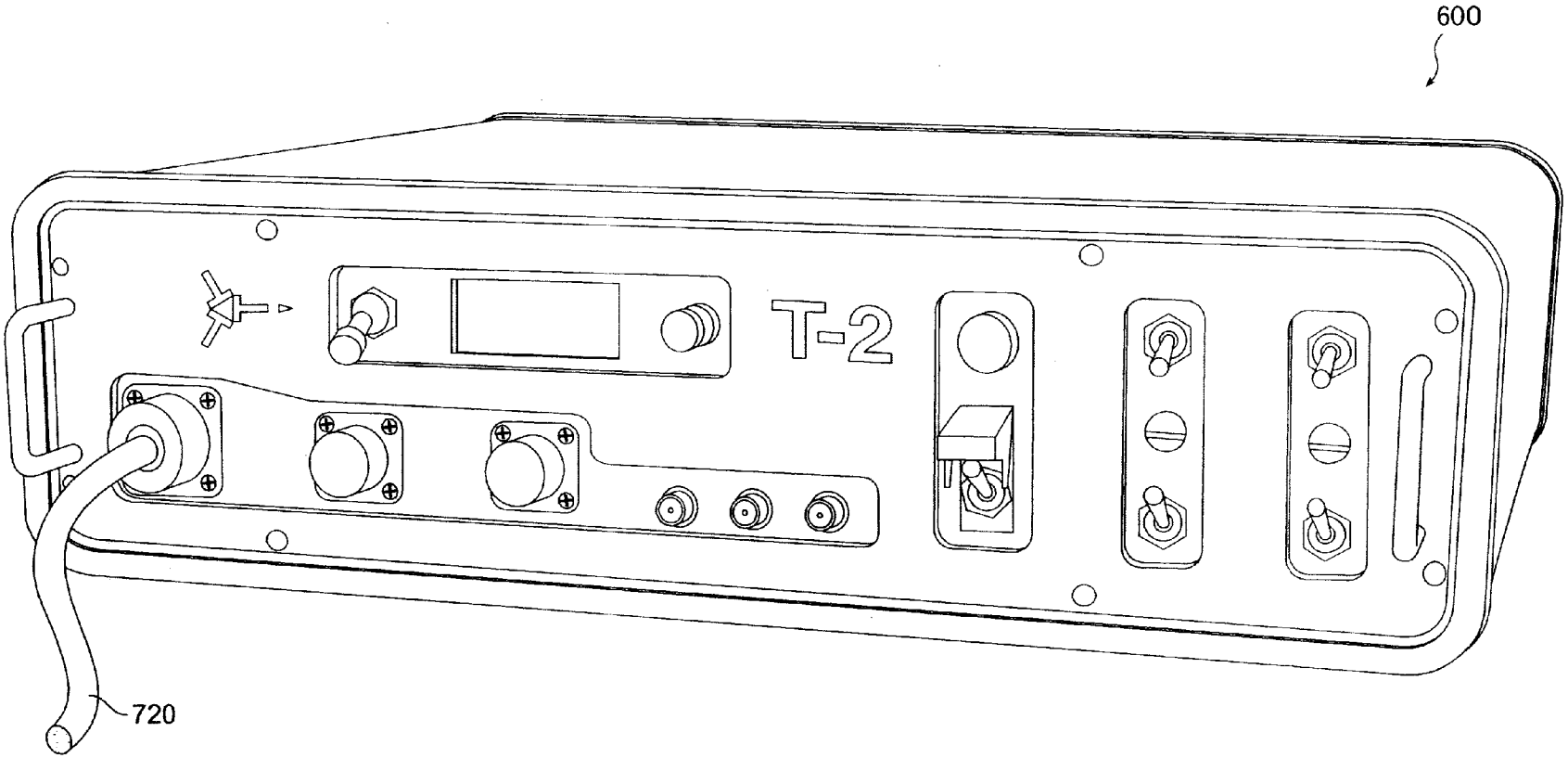
FIG. 8 is an illustration of a control unit that contains signal processing means to generate electrical control signals used to determine the pointing direction of the firearm device.

In the described embodiment, user operation of two-axis hand controller device 706 generates an electrical input signal which is transmitted via an electrical cable 720 or other transmission means to a control unit 600 similar to the one pictured in FIG. 8. The control unit 600 includes means for processing the input signal so as to generate the electrical control signals used to determine the pointing direction 302 of pointing device 300. Signal processing within control unit 600 may occur via an analog or integrated circuit, or on a microprocessor, preferably on a simple microprocessor chip, in a manner readily understood by one of ordinary skill in the art, by converting voltages or digital signals from the joystick 708 or other controllers on two-axis hand controller device 706 and various triggers and switches to electrical signals that control the electronic servomotors.

In the described embodiment signal processing is performed by microprocessor such that the first axis 800 of hand controller device 706 corresponds to the first axis 322 of aiming mechanism 300, and the second axis 802 of the hand controller device 706 corresponds to the second axis 324 of the aiming mechanism 300. For each axis, the control unit converts a hand controller position that is within the dead zone 804 to an electronic control signal that generates no movement in the pointing direction 302 of the firearm device 300 along the corresponding axis; a transition from the dead zone 804 into the single positive step region 810 or single negative step region 814 into a signal causing movement of the aiming position by a predetermined positive or negative angle respectively, corresponding to a single positive or negative step of the corresponding stepper motor 400, or a position in the region of positive displacement 812 or the region of negative displacement 816 into an electronic control signal that generates a continuous movement in the pointing direction 302 in the positive or negative direction respectively. In the described embodiment, the signal processor converts greater displacements within the region of positive displacement 812 or the region of negative displacement 816 into electronic control signals that cause faster movement of in the pointing direction 302.

In the described embodiment two-axis calibration indicators 1008 employ cross-hatches of an appropriate size such that a single step or fixed number of steps of server motor 400 are sufficient to change pointing direction 302 in the exact amount so as to shift targeting centerpoint 1010 over by exactly one hash mark. Thus, an operator may use the two-axis calibration indicators to judge how many hash marks intended target 1004 lies away from targeting centerpoint 1010. To bring target 1004 exactly into targeting centerpoint 1010, the user must toggle two-axis hand controller 706 from the dead zone to the single step region for the appropriate axis and back, a number of times that depends on the distance. In yet other preferred embodiments, the space between hash marks on two-axis calibration indicators may increase or decrease, according to the amount of zoom being used by video acquisition means used to view the scene.

Control unit 600 also incorporates control signal transmission means to transmit the electrical control signals to actuators 310 and 312. In the described embodiment, transmission means consist of electrical cable, although in other embodiments a variety of widely known alternate electrical signal transmission means may be used, such as radio frequency transmitters and receivers or fiber optics cable.

It should be noted that the physical pointing device and the physical pointing control means discussed above are optional, and that some preferred embodiments of the invention use computer simulations of devices and pointing locations rather than operating and pointing a physical device.

Furthermore, in other preferred embodiments, the location for the various control, processing, display, and perceptual feedback means may be altered.

Perceptual Feedback

In the described embodiment, the control 600 unit also contains processing means for generating perceptual signals in response to operation of hand controller device 706. Each such perceptual signal is divided into two sub-signals, one to correspond to each of the axes of operation of the positioning means of the pointing device 300.

Control unit 600 contains audio processing means for generating stereo audio signals in response to operation of hand controller device 706. Each sub-signal optionally contains a pitch that varies in relation to the speed of operation for the positioning means, preferably including a tone of a frequency proportionately to the speed of aiming of the positioning means when the speed of aiming is above a certain threshold, and a series of audible clicks when the speed of aiming is below or equal to that threshold. When stepper motors are used as positioning means, it is convenient to make the frequency of each signal expressed as cycles per second vary in proportion to the number of positioning steps per second taken by the corresponding motor. In another preferred embodiment, the audio processing means and the means for processing the input signal generated by the hand controller device 706 are the same, so that the audio signal consists of the electronic control signals that determine the pointing direction 302 of the aiming device 300. These audio signals may optionally be processed at other locations, such as on hand controller 706, and may further be presented to the user by means of speaker 726 or headphones 722 attached to hand controller device 706, or an external speaker connected to output cable 718.

It will be apparent to one of ordinary skill in the art that because the frequency of each signal is proportionate to the speed of movement along a corresponding axis, then a movement in any given direction is marked by a ratio of pitches, with the ratio (and hence the perceived interval between the pitches) remaining constant as long as the movement continues in that direction.

In the described embodiment, the control unit also contains video or computer processing means for generating direction of movement indicators in response to operation of hand controller device 706. The indicators optionally include a shape or object that varies in size, shape, color, or location, or a combination of the above, in relation to the speed of operation for the positioning means with a variance that increases in relation to the speed of aiming of the positioning means when the speed of aiming is above a certain threshold, and that consists of a series of visible flashes or discrete movements or pulses when the speed of aiming is below or equal to that threshold. When stepper motors are used as positioning means, it is convenient to make the frequency of such flashes, movements, or pulses, expressed as cycles per second, vary in proportion to the number of positioning steps per second taken by the corresponding motor. In the described embodiment, these indicators are displayed on visual indicators 728 on two-axis hand controller device 706, and also via motion indicators 1012 on screen 1002. For example, in response to a single positioning step that increases the elevation of pointing device 300, the visual indicator 728 on the upper portion of two axis hand controller 306 may flash once. Additionally, motion indicator 1012 at the upper part of screen 1002 will flash once in response to the movement. As the upward positioning steps occur with greater frequency, the flashing increases in speed or intensity, or is otherwise altered to indicate the speed of movement.

In the described embodiment, the control unit further contains means for generating tactile responses to operation of hand controller device 706. The tactile responses optionally vary in intensity, location, or vibrational frequency in relation to the speed of operation for the positioning means with an intensity or location that increases in relation to the speed of aiming of the positioning means when the speed of aiming is above a certain threshold, and that consists of a series of tactile pulses when the speed of aiming is below or equal to that threshold. When stepper motors are used as positioning means, it is convenient to make the frequency of such pulses, expressed as cycles per second, vary in proportion to the number of positioning steps per second taken by the corresponding motor. The tactile response may be produced via tactile signal generator 724 attached to hand-controller device 706.

Control unit 600 further contains optional means for processing input signals from the two-axis hand controller device 706, obtaining user input from the control unit 600, and generating electronic control signals, pertaining to other operational parameters of screen 1002, pointing device 300, and monitor 300. For example, in the case of pointing firearms, control unit 600 may be used to process instructions to fire the device, to enter estimates of wind speed and range, or to alter the camera zoom angle.

Training Mode

In the described embodiment, the present invention provides a training mode, which is a method by which operators may be trained in the aiming and use of pointing devices by simulating their operation.

In one preferred embodiment, operators may be trained in the operation of firearm device 306 using two-axis hand controller device 706, by presenting images on screen 1002, displayed on optional portable viewfinder 700, display device 900, or elsewhere, simulating the firing of a projectile from device 706. Because the trajectory path and targeting location 304 are known with substantial precision, the actual firing of a physical projectile is not required in order to determine whether the operator has hit intended target 1004. Instead, a computer routine executing inside of control unit 600 or elsewhere simply records the location of targeting centerpoint 1010 at the moment the operator pressed control 712 in order to activate the trigger of firearm device 306. A hit is scored if and only if physical target 1004 is determined to be within targeting centerpoint 1010. Alternately, a video capture system may be used to record the images on screen 1002 at the time of firing. Furthermore, because no projectile is fired, operators may be trained in firing scenerios that involve live human targets captured by video recording means and that are otherwise more realistic than the typical shooting gallery and pop-up training methodologies. Nevertheless, training may also be performed using prerecorded or computer-generated images of targets on screen 1002.

As discussed above, targeting centerpoint 1010 may be merely a stationary region in the center of screen 1002 aligned in the pointing direction 302, or alternately, a calculated location that depends on range, wind, and other factors.

In the preferred embodiment, to simulate the actual firing of firearm device 306, at the time of firing control unit 600 instructs linear actuators 310 and 312 to rapidly jolt the carriage in a motion simulating a recoil action. The operator will therefore see a quick shift in the image displayed in screen 1002 that appears as if the firearm had been fired. In alternate embodiments, the displacement due to recoil may be simulated merely by quickly shifting the image displayed in screen 1002 using either video or computer technology. In alternate embodiments, the simulation may be made even more realistic by the introduction of a computer-generated or prerecorded flash or smoke cloud into the image on screen 1002 immediately after firing. Optionally, a noise may be generated for the purpose of enhancing realism that simulates the sound of the firing of firearm device 306.

It will be appreciated by those skilled in the art that other means may be used to control and position firearm device 306 and still achieve the benefits of the disclosed invention. For example, in alternate preferred embodiments, firearms are controlled remotely by control means other than two-axis hand controller device 706. In yet other preferred embodiments firearm device 306 may be positioned using a mechanism entirely different than that pictured and described in connection with FIG. 5. The essential requirement is that firearm device must be positioned reliably and steadily by remote control, in such a way that its exact point of aim may be determined at the moment of simulated firing.

Although the foregoing invention has been described in detail for purposes of clarity of understanding, it will be apparent that certain changes and modifications may be practiced within the scope of the appended claims. For example, the base of the present invention may be a pole rather than a tripod. Alternately, the base may be a large weighted solid, or a mount by which the device is affixed to a vehicle or other platform. In general, it should be noted that there are alternative ways of implementing the apparatus of the present invention. It is therefore intended that the following appended claims be interpreted as including all such alterations, permutations, and equivalents as fall within the spirit and scope of the present invention.

What is claimed is:

1. A telepresent aiming system comprising (a) a base for engaging a mounting surface;

(b) a device connected to said base, and pointing in a direction;

(c) positioning means for aiming said device at a first aiming speed along a first axis and a second aiming speed along a second axis substantially perpendicular to said first axis, in response to electronic control signals;

(d) a two axis hand controller device manually operated by a user;

(e) signal processing means operationally coupled to said hand controller device, said signal processing means generating said electronic control signals in response to operation of said hand controller device, a first audio signal corresponding to said first aiming speed, and a second audio signal corresponding to said second aiming speed; and a (f) control signal transmission means for transmitting said electronic control signals from said signal processing means to said positioning means.

2. The system of claim 1 wherein the system can be used in a training mode.

* * * * *